US006503109B1

(12) United States Patent
Duffield et al.

(10) Patent No.: US 6,503,109 B1
(45) Date of Patent: Jan. 7, 2003

(54) SWIVEL DRIVE ASSEMBLY

(76) Inventors: Marshall D. Duffield, 2531 Vista Dr., Newport Beach, CA (US) 92660; Jack A Heiser, 1508 Ruth La., Newport Beach, CA (US) 92660

( * ) Notice: Subject to any disclaimer, the term of this patent is extended or adjusted under 35 U.S.C. 154(b) by 0 days.

(21) Appl. No.: 09/619,090

(22) Filed: Jul. 19, 2000

(51) Int. Cl.[7] ..... B63H 25/42

(52) U.S. Cl. ..... 440/51; 440/6; 440/52; 440/53

(58) Field of Search ..... 440/6, 7, 52, 53, 440/51, 49, 57, 59, 61; 114/151, 144 R

(56) References Cited

U.S. PATENT DOCUMENTS

| | | | | |
|---|---|---|---|---|
| 2,794,410 A | * | 6/1957 | Oliver et al. | 440/6 |
| 3,279,417 A | * | 10/1966 | Moore et la. | 440/53 |
| 3,924,556 A | * | 12/1975 | Wacker | 440/6 |
| 4,040,378 A | * | 8/1977 | Blanchard | 440/52 |
| 4,278,431 A | * | 7/1981 | Krutkremer et al. | 440/53 |
| 4,815,996 A | * | 3/1989 | Carr | 440/53 |
| 5,108,325 A | * | 4/1992 | Livingston et al. | 440/53 |
| 5,947,779 A | * | 9/1999 | Heideman et al. | 440/6 |

OTHER PUBLICATIONS

Duffy electric boat co., Brochure: Duffy Electric Cat 16, Mar. 1, 2000, 4 pages.

Duffy Electric Boat Co., Brochure: Duffy Electric 16 Classic, 8/98, 4 pages.

Duffy Electric Boat Co., Brochure: Duffy Electric 17, undated, 2 pages.

Duffy Electric Boat Co., Brochure: Duffy Electric 18, Mar. 1, 2000, 4 pages.

Duffy Electric Boat Co., Brochure: Duffy Electric 21, Mar. 1, 2000, 4 pages.

Kathleen Haney, "Charged Up", Daily Pilot, Jul. 13, 1998, 1 page.

David Lansing, "Bay cruise heals hectic lie", The Orange County Register, Jul. 4, 1998, 1 page.

Duffy Electric Boats, Promotional literature: "Duffy Electric Boats Ranked Leader in the Electric Boat Industry", undated, 5 pages.

Duffy Electric Boats, Promotional literature: "Duffy Voyager Sets World Record for Speed by an Electric Boat Between Newport Beach and Long Beach Harbors and Pulls out of the Water for Ventura Boat Show", undated, 3 pages.

Duffy Electric Boats, Promotional literature: "Duffy Electric Boars Opens Fort Lauderdale, Florida Office", undated, 1 page.

* cited by examiner

*Primary Examiner*—Stephen Avila
(74) *Attorney, Agent, or Firm*—Stetina Brunda Garred & Brucker

(57) ABSTRACT

A swivel drive assembly for an electrically powered boat. The swivel drive assembly comprising a housing which has a propeller shaft extending therethrough and a propeller mechanically coupled to the propeller shaft. The swivel drive assembly further includes a turning post having a hollow interior mechanically coupled to the housing. A drive shaft is mechanically coupled to the propeller shaft and is disposed within the hollow interior of the turning post and the housing. The swivel drive assembly further includes an electric motor mechanically coupled to the drive shaft and operable to spin the propeller thereby. In this respect, the rotation of the turning post is operative to point the housing and the propeller in a desired direction to facilitate steering of the boat.

15 Claims, 5 Drawing Sheets

SWIVEL DRIVE ASSEMBLY

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention generally relates to a propulsion system for an electric boat, and more particularly to a swivel drive assembly.

Electric boats typically use a direct drive system for propulsion. In such a system, a propeller of the boat is attached to a propeller shaft which extends from the bottom thereof. The propeller shaft extends through the bottom of the boat via a stuffing box which prevents water from entering the boat. Disposed on an end of the propeller shaft opposite the propeller is a pulley. The pulley is coupled to an electric motor via a belt. Accordingly, as the electric motor rotates, the propeller shaft rotates thereby spinning the propeller and pushing the electric boat. By controlling the direction of rotation and speed of the electric motor, it is possible to control the speed and direction of the boat.

In order to maneuver the electric boat, there is typically provided at least one rudder, preferably two. Typically, the rudder is disposed aft of the propeller. By turning the rudder, water flowing thereover will be redirected thereby turning the boat. However, in order for the rudder of the electric boat to be effective, it is necessary for the electric boat to maintain a minimum speed. In this respect, water must flow over the rudder of the electric boat at a prescribed rate in order for the electric boat to turn. At slow speeds, the electric boat will become difficult to handle thereby resulting in an increase of danger to the passengers of the boat because water is not flowing over the rudder at the prescribed rate.

Additionally, as previously mentioned, the prior art direct drive system for the electric boat comprises an elongate propeller shaft extending through the bottom of the boat to the electric motor. The electric motor is mounted to the boat through the use of brackets such that the pulley of the propeller shaft, as well as the drive belt of the electric motor are disposed within a housing in the interior of the electric boat. The housing typically consumes valuable interior space of the electric boat that could be used for passengers.

The present invention addresses the above-mentioned deficiencies in the prior art direct drive systems for electric boats by providing a swivel drive system. The swivel drive system of the present invention consumes less interior space than the conventional direct drive system thereby providing extra interior room for passengers. Additionally, the swivel drive system, constructed in accordance with the preferred embodiment of the present invention, provides an assembly which greatly enhances the maneuverability of the electric boat at slow speeds. In this respect, the swivel drive system is capable of positioning the propeller of the electric boat in a direction which facilitates turning.

BRIEF SUMMARY OF THE INVENTION

A swivel drive assembly for an electrically powered boat. The swivel drive assembly comprising a housing which has a propeller shaft extending therethrough and a propeller mechanically coupled to the propeller shaft. The swivel drive assembly further includes a turning post having a hollow interior mechanically coupled to the housing. A drive shaft is mechanically coupled to the propeller shaft and is disposed within the hollow interior of the turning post and the housing. The swivel drive assembly further includes an electric motor mechanically coupled to the drive shaft and operable to spin the propeller thereby. In this respect, the rotation of the turning post is operative to point the housing and the propeller in a desired direction to facilitate steering of the boat.

In the preferred embodiment of the present invention, the housing further comprises a gear mechanism mechanically coupled to the propeller shaft and the drive shaft. In this respect, the gear mechanism comprises a first bevel gear mechanically coupled to the propeller shaft and a second bevel gear mechanically coupled to the drive shaft and cooperatively engaged to the first bevel gear. Typically, the first and second bevel gears are spiral cut bevel gears in order to reduce noise and vibration of the swivel drive assembly.

In order to prevent water from entering the electric boat, the swivel drive assembly of the present invention further includes a seal mounted to the boat. The seal has an interior bore sized slightly larger than the turning post such that the turning post is extensible through the seal. The seal may include a vibration dampening member configured to reduce vibrations between the swivel drive assembly and the boat. Typically, the dampening member is formed from an elastomeric material.

In the preferred embodiment of the present invention, the seal has a housing with a hollow interior and the dampening member is disposed therein. The dampening member is formed with a cylindrical bore extending therethrough. The seal further includes a cylindrical bushing disposed within the cylindrical bore of the dampening member. The bushing has a hollow interior sized slightly larger than the turning post such that the turning post is extensible therethrough. Additionally, the seal may further include an oil seal disposed adjacent to the bushing and the turning post in order to prevent water from entering the boat from the space between the turning post and the bushing. The seal may further include a bearing disposed adjacent to the bushing and the turning post in order to facilitate rotation of the turning post.

The swivel drive assembly of the present invention may further include a motor mount attached to the electric motor and the turning post. In this respect, as the motor mount is rotated, the turning post is rotated thereby pointing the propeller in the desired direction to steer the boat. Additionally, the electric motor may include an output shaft mechanically coupled to the drive shaft through the use of a spline coupling.

In accordance with the present invention there is provided a method of controlling vibrations in an electrically powered boat having an electric motor, a drive shaft, a propeller shaft, a propeller, and a vibration dampening member. The method comprises attaching the vibration dampening member to the electric boat. Next, the electric motor is coupled to the vibration dampening member and the drive shaft is attached to the electric motor. The drive shaft is extended through the vibration dampening member and mechanically coupled to the propeller shaft. Next, the propeller is attached to the propeller shaft and spun by the electric motor such that vibrations may be created. In the preferred embodiment, the dampening member will reduce the vibrations caused by the spinning of the electric motor and the propeller. In the preferred embodiment, a gear mechanism mechanically couples the drive shaft to the propeller shaft. In this respect, the gear mechanism comprises a first spiral cut bevel gear and a second spiral cut bevel gear which are capable of reducing vibration and noise within the swivel drive assembly of the present invention.

BRIEF DESCRIPTION OF THE DRAWINGS

These as well as other features of the present invention will become more apparent upon reference to the drawings wherein.

DETAILED DESCRIPTION OF THE INVENTION

Figure 1:
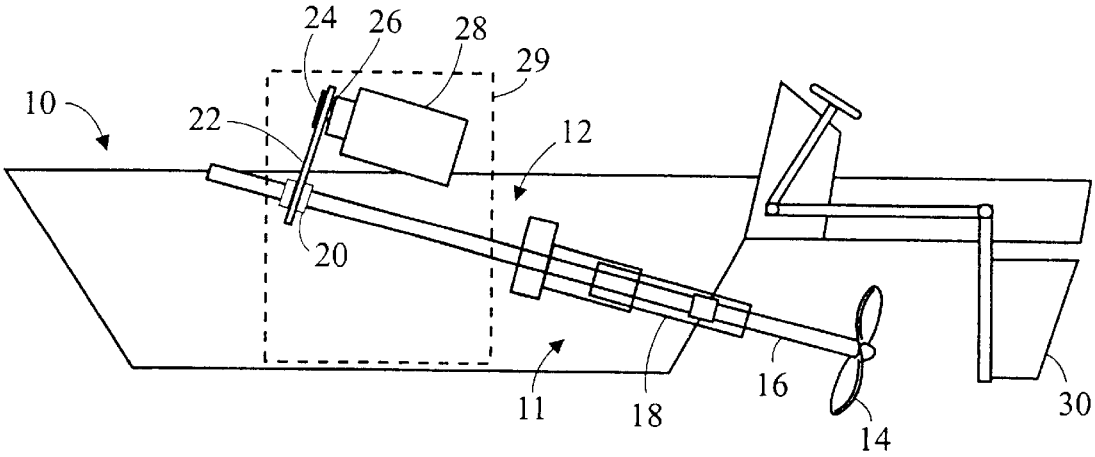
Fig. 1 (PRIOR ART)
FIG. 1 is a cross-sectional view of an electric boat using a prior art method of propulsion.

Referring now to the drawings wherein the showings are for purposes of illustrating a preferred embodiment of the present invention only, and not for purposes of limiting the same, FIG. 1 is a cross-sectional view of an electric boat 10 having a prior art propulsion system 12. Specifically, the prior art propulsion system 12 includes a propeller 14 attached to a propeller shaft 16 that extends from a bottom 11 of the boat 10. The propeller shaft 16 extends through a stuffing box 18 which prevents water from entering the interior of the boat 10. Typically, the stuffing box 18 contains a seal which allows the propeller shaft 16 to rotate, while preventing water from entering the boat 10. A deficiency with the stuffing box 18 is the tendency to leak. Additionally, the seal in the stuffing box 18 may fail thereby leading to water entering the boat 10.

Referring to FIG. 1, the propeller shaft 16 extends upwardly from the stuffing box 18 into the interior of the boat 10. Attached to an end of the propeller shaft 16, opposite the propeller 14, is a first pulley 20. A belt 22 wraps around the first pulley 20 and attaches to a second pulley 24 attached to a drive shaft 26 of an electric motor 28. In this respect, the electric motor 28 rotates the drive shaft 26 thereby turning the second pulley 24. As the belt 22 rotates, the first pulley 20, propeller shaft 16, and propeller 14 rotate thereby resulting in propulsion of the boat 10.

As seen in FIG. 1, the propeller shaft 16 extends upwardly into the boat 10 thereby consuming interior space. Additionally, the electric motor 28 is mounted near the end of the propeller shaft 16 such that the electric motor 28 consumes interior space of the boat 10. In fact, often times the manufacturer of the electric boat 10 will include a housing 29 to cover the prior art propulsion system 12. For example, the housing 29 may be the steering console for the boat 10. The prior art propulsion system 12 for electric boats is disadvantaged because it consumes valuable interior space.

In order to steer the electric boat 10 with the prior art propulsion system 12, a rudder 30 is mounted aft of the propeller 14. The rudder 30 is operative to direct the flow of water created by the movement of the boat 10. Often times, in order to increase effectiveness, the boat 10 may be provided with twin rudders 30 positioned in a side-by-side configuration. In order for the rudder 30 to be effective, the boat 10 must be moving at a minimum speed such that water is flowing over the rudder 30 at a prescribed rate. If the electric boat 10 is not moving fast enough, then the flow of water over the rudder 30 is not adequate and the electric boat 10 loses steerage. Accordingly, a problem exists while docking the electric boat 10 where the operator of the boat will need to go slowly into the dock in order to make a safe landing. If the boat 10 docks to slowly, then the boat 10 will lose steerage. Alternatively, if the boat 10 is moving quickly, then there is the risk of damage to the boat 10 from colliding with the dock. Therefore docking an electric boat can be a difficult task for the operator because the correct speed must be used.

Figure 2:
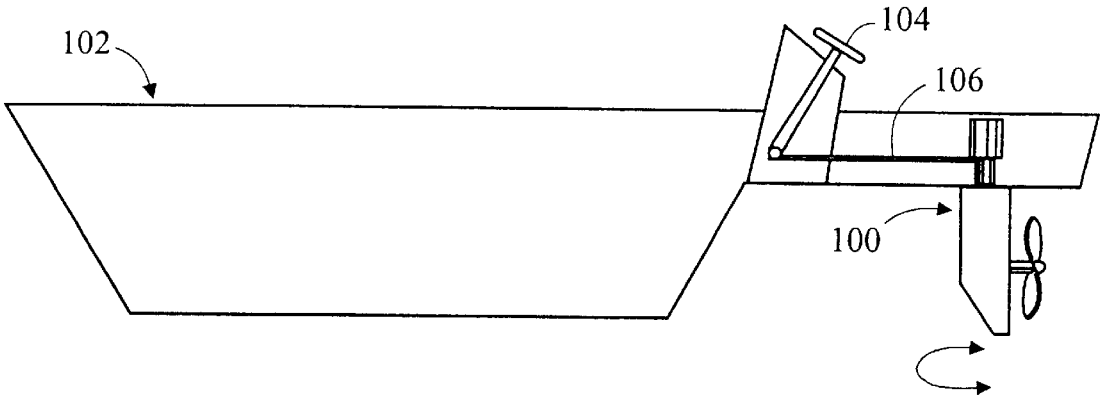
FIG. 2 is a cross-sectional view of the electric boat shown in FIG. 1 using a swivel drive assembly of the present invention as the method of propulsion.
Figure 3:
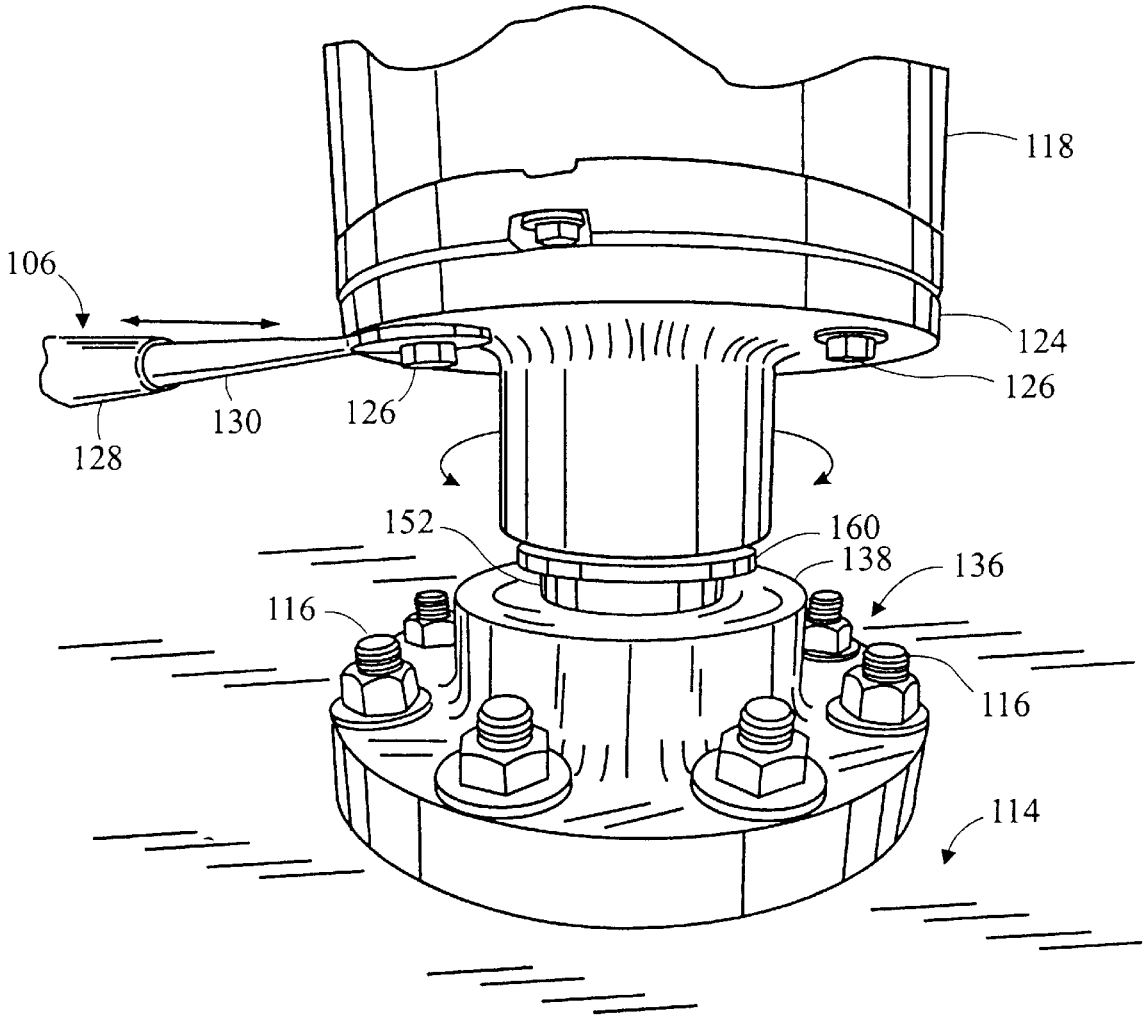
FIG. 3 is a perspective view of a seal and motor for the swivel drive assembly of the present invention.

The present invention addresses the above-mentioned deficiencies in the prior art propulsion system 12 by providing a swivel drive assembly 100 that facilitates maneuvering an electric boat 102. Specifically, as seen in FIG. 2, the swivel drive assembly 100 is positioned near the location of the rudder 30 of the electric boat 10 having the prior art propulsion system 12. The swivel drive assembly 100 can rotate such that the assembly 100 can direct the flow of water propelled therefrom to turn the boat 102 (as will be further explained below). The swivel drive assembly 100 is linked to a steering wheel 104 of the boat 102 through a steering cable 106. In this respect, the operator of the boat 102 can turn the wheel 104 to rotate the swivel drive assembly 100. In addition to facilitating the steering of the boat 102, the swivel drive assembly 100 provides a compact propulsion unit for the boat 102. Specifically, the swivel drive assembly 100 can be mounted in the stern of the boat 102 to conserve space. Accordingly, as seen in FIG. 2, the electric boat 102 equipped with the swivel drive assembly 100 of the present invention has more interior room than the electric boat 10 with the prior art propulsion system 12.

Figure 4:
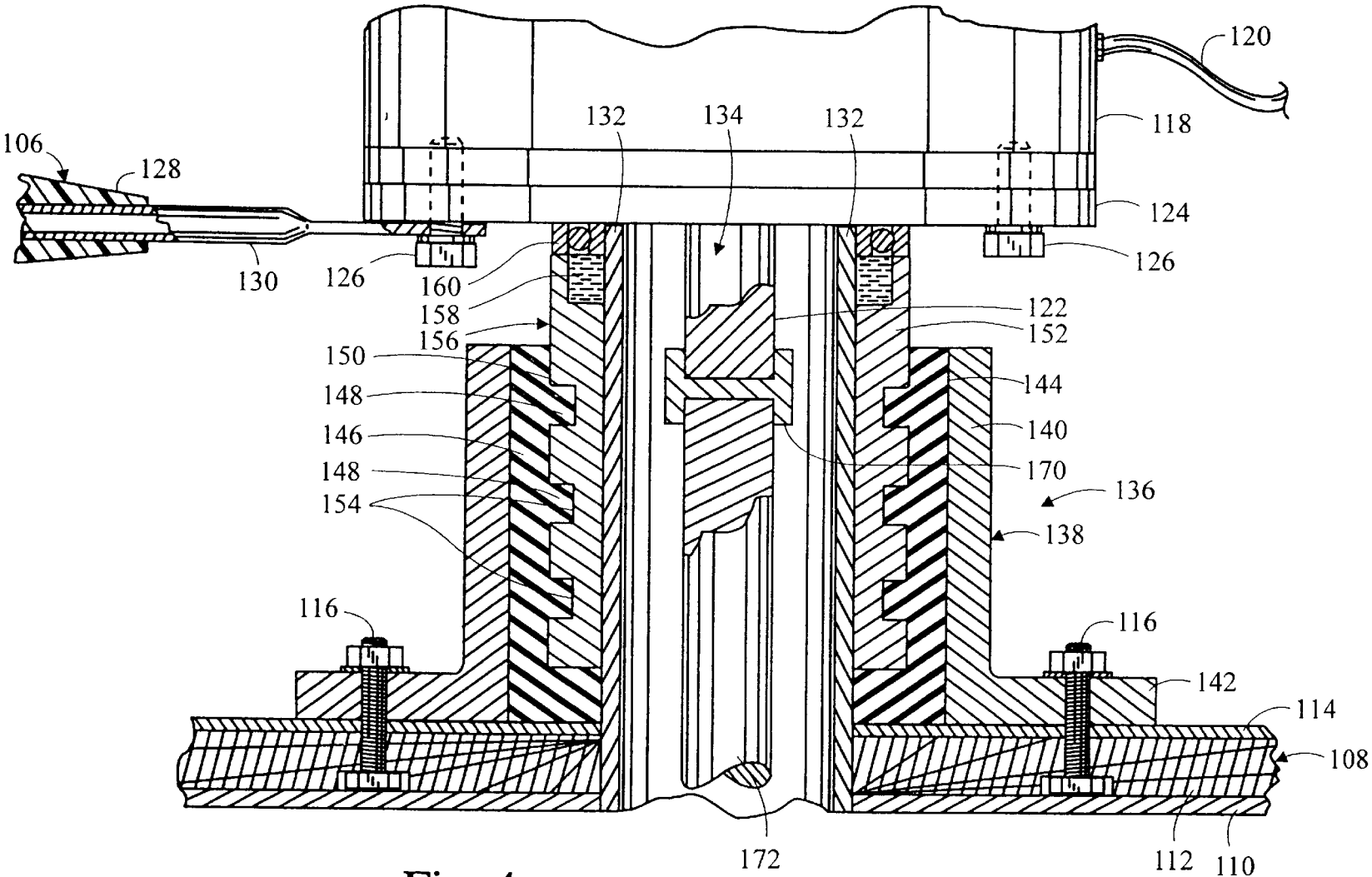
FIG. 4 is a cross-sectional view of the upper portion of the swivel drive assembly of the present invention.
Figure 6:
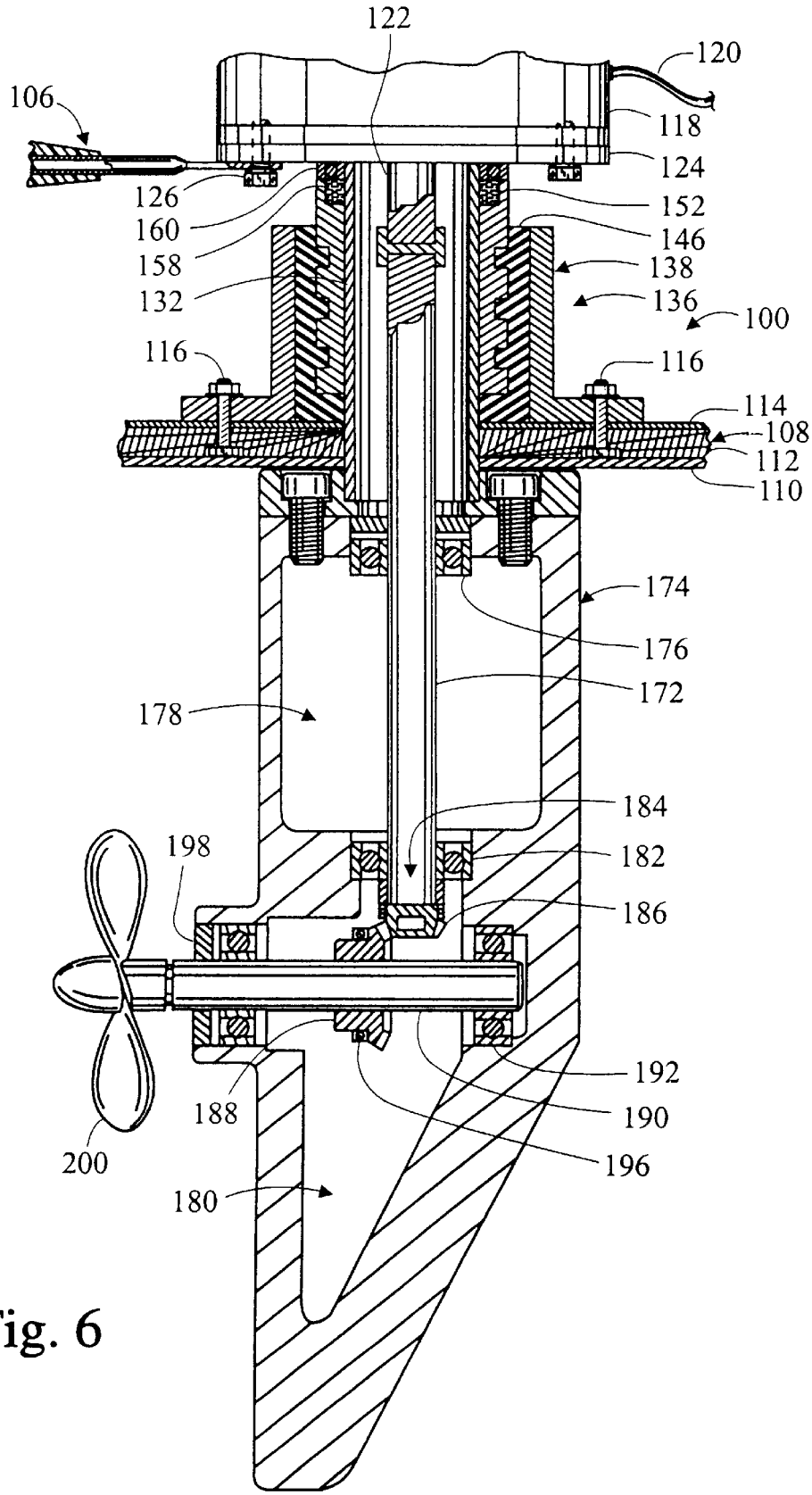
FIG. 6 is a cross-sectional view of the swivel drive assembly constructed in accordance with the present invention.

Referring to FIGS. 4 and 6, the swivel drive assembly 100 is mounted to the hull 108 of the boat 102. Specifically, the hull 108, at the location of the swivel drive assembly 100, comprises an outer fiberglass layer 110, an inner fiberglass layer 114, and a plywood layer 112 sandwiched therebetween. The plywood layer 112 is bonded to both the inner and outer fiberglass layers 110, 114 such that a unitary structure is formed thereby. Disposed within apertures of the plywood layer 112 and projecting upwardly through the inner layer 114 into the interior of the boat 102 are mounting bolts 116. Each of the mounting bolts 116 is placed within the plywood layer 112 before bonding the same between the inner and outer fiberglass layers 110, 114. The mounting bolts 116 are used to attach swivel drive assembly 100 to the hull 108 of the boat 102, as will be further explained below.

The swivel drive assembly 100 has an electric motor 118 as the drive mechanism. The electric motor 118 is typically connected to an electronic speed control and a set of batteries through power cable 120. The batteries and speed control are operative to rotate an output shaft 122 of the electric motor 118 at a desired direction and rate.

The motor 118 is attached to a generally circular mounting plate 124 with multiple bolts 126. The mounting plate 124 generally has the same diameter as the motor 118, such that the motor 118 can be mounted directly thereon. The motor 118 is formed with threaded bores wherein each of the bolts 126 may be threaded therein. Specifically, each of the bolts 126 is placed through a respective aperture formed in the mounting plate 124 and threaded into the threaded bores of the motor 118. By tightening the bolts 126, the motor 118 is as secured to the mounting plate 124. As seen in FIG. 4, the output shaft 122 of motor 118 is advanced through an aperture (not shown) formed in the center of the mounting plate 124.

As seen in FIG. 4, the steering cable 106 is secured to one of the bolts 126. The steering cable 106 comprises an outer sheath 128 disposed about an interior cable 130. The end of the interior cable 130 is flattened and forms a flange which contains an aperture (not shown). The bolt 126 is projected through the aperture of the interior cable 130 such that the flattened portion of the interior cable 130 is sandwiched between a lower surface of the mounting plate 124 and the head of the bolt 126. Typically, the bolt 126 that is attached to the interior cable 130 is tightened to a setting that allows the aperture of the interior cable 103 to rotate freely around the bolt 126. In this respect, a set of washers may be placed between the head of the bolt 126, mounting plate 124 and interior cable 130 to prevent binding of the interior cable 130 and facilitate rotation thereof around the bolt 126. As will be further explained below, the advancement and retraction of the interior cable 130 from the sheath 128 is operative to rotate the swivel drive assembly 100 to turn the boat 102.

Referring to FIG. 4, attached to the mounting plate 124 is a cylindrical turning post 132 having a hollow interior 134. The turning post 132 is attached to the mounting plate 124 in a location whereat the turning post 132 is coaxially aligned with the output shaft 122 of the motor 118. In this respect, the output shaft 122 is disposed within the hollow interior 134 of the turning post 132. The turning post 132 is typically fabricated from a metallic material such as stainless steel tubing. Furthermore, the turning post 132 is attached to the mounting plate via a method (e.g., welding) which allows the turning post 132 to rotate as the mounting plate 124 is rotated.

In order to prevent water from entering the boat 102 and prevent vibrations of the electric motor 118 being transferred to the hull 108 of the boat 102, the swivel drive assembly 100 includes a seal unit 136 mounted to the hull 108. The seal unit 136 has a housing 138 formed from a metallic material. As seen in FIGS. 4 and 6, the housing 138 is generally cylindrical and encloses the turning post 132. The housing 138 has a generally cylindrical body section 140 which transitions into a circular flange section 142. Each of the bolts 116 projects upwardly through apertures formed in the flange section 142 of housing 138 in order to secure the seal unit 136 to the hull 108 of the boat 102. The body section 140 of the housing 138 has a generally cylindrical interior surface 144. In abutting contact with the interior surface 144 is a vibration dampening member 146 formed from an elastomeric material. The vibration dampening member 146 is generally cylindrical and is formed slightly smaller than the inner diameter of the body section 140 of housing 138. In this respect, the dampening member 146 can be inserted or formed into the interior of the housing 138. The dampening member 146 has a generally cylindrical bore 150 formed within the center thereof. The bore 150 is coaxially aligned with the with the output shaft 122 of the motor 118 and turning post 132, as will be further explained below. The dampening member 146 is formed with a series of notches 148 formed on an interior surface of the bore 150. The notches 148 are disposed circumferentially about the bore 150 and evenly spaced along the central axis thereof. As seen in FIG. 4, there are four notches 148 formed in the dampening member 146. However, the number and size of the notches 148 may vary as desired. Because the dampening member 146 is formed from an elastomeric material, vibration from the motor 118 and other components of the swivel drive assembly 100 will be absorbed by the dampening member 146 are not transmitted to the hull 108 of the boat 102.

The seal unit 136 further includes a generally cylindrical bronze bushing 152 to support the turning post 132. The bushing 152 is disposed within the bore 150 of the vibration dampening member 146. The bushing 152 is formed with a series of grooves 154 disposed about the outer surface thereof. More specifically, the grooves 154 are formed complementary to the notches 148 of the of the dampening member 146 such that the notches 148 lock with the grooves 154 and the bushing 152 is retained within the bore 150 of the dampening member 146. As previously mentioned, the number of grooves 154 and notches 148 may vary in order to properly retain the bushing 152 within the dampening member 146 and prevent push out thereof. The inner diameter of the bushing 152 is sized slightly larger than the outer diameter of the turning post 132 such that the turning post 132 is in contact with the bushing 152 when extended there through, as seen in FIG. 6. In this respect, the bushing 152 provides a surface that the turning post 132 rotates against. As will be recognized by those of ordinary skill in the art, the bushing 152 is fabricated from bronze to reduce corrosion.

Disposed on an upper portion 156 of the bushing 152 is an annular oil seal 158 and an annular bearing 160. As seen in FIG. 4, the annular oil seal 158 is disposed within the interior of the bushing 152 such that it is in contact with both the turning post 132 and the bushing 152. The oil seal 158 is circumferentially disposed about the interior diameter of the bushing 152 and the outer diameter of the turning post 132. In this respect, the oil seal 158 provides a watertight seal that prevents water between turning post 132 and bushing 152 from entering the boat 102. Accordingly, water outside the hull 108 that leaks through the space between the turning post 132 and bushing 152 at outer fiberglass layer 110 is prevented from entering the boat 102 by the oil seal 158.

The bearing 160 is circumferentially disposed about the top portion 156 of the bushing 152 and is in abutting contact with the lower surface of the mounting plate 124. The bearing 160 is attached to both the bushing 152 and the mounting plate 124 and provides free rotation of the mounting plate 124 with respect to the bushing 152. Therefore, the mounting plate 124 with motor 118 can freely rotate on the top of the bushing 152. Additionally, because the turning post 132 is fixedly attached to the mounting plate 124, the turning post 132 can rotate within the bushing 152. The bearing 160 may comprise ball bearings in order to facilitate the rotation of the mounting plate 124.

As previously mentioned, the output shaft 122 extends downwardly from the motor 118 into the interior 134 of the turning post 132. Disposed on the end of the output shaft 122 opposite the motor 118 is a cylindrical spline coupling 170. The spline coupling is operative to join the output shaft 122 with a cylindrical drive shaft 172, as seen in FIG. 4. As seen in FIGS. 4 and 6, the drive shaft 172 extends downwardly through the interior 134 of the turning post 132 and is coaxially aligned therein. In the preferred embodiment of the present invention, the drive shaft 172 is fabricated from a metallic material such as stainless steel.

Figure 5:
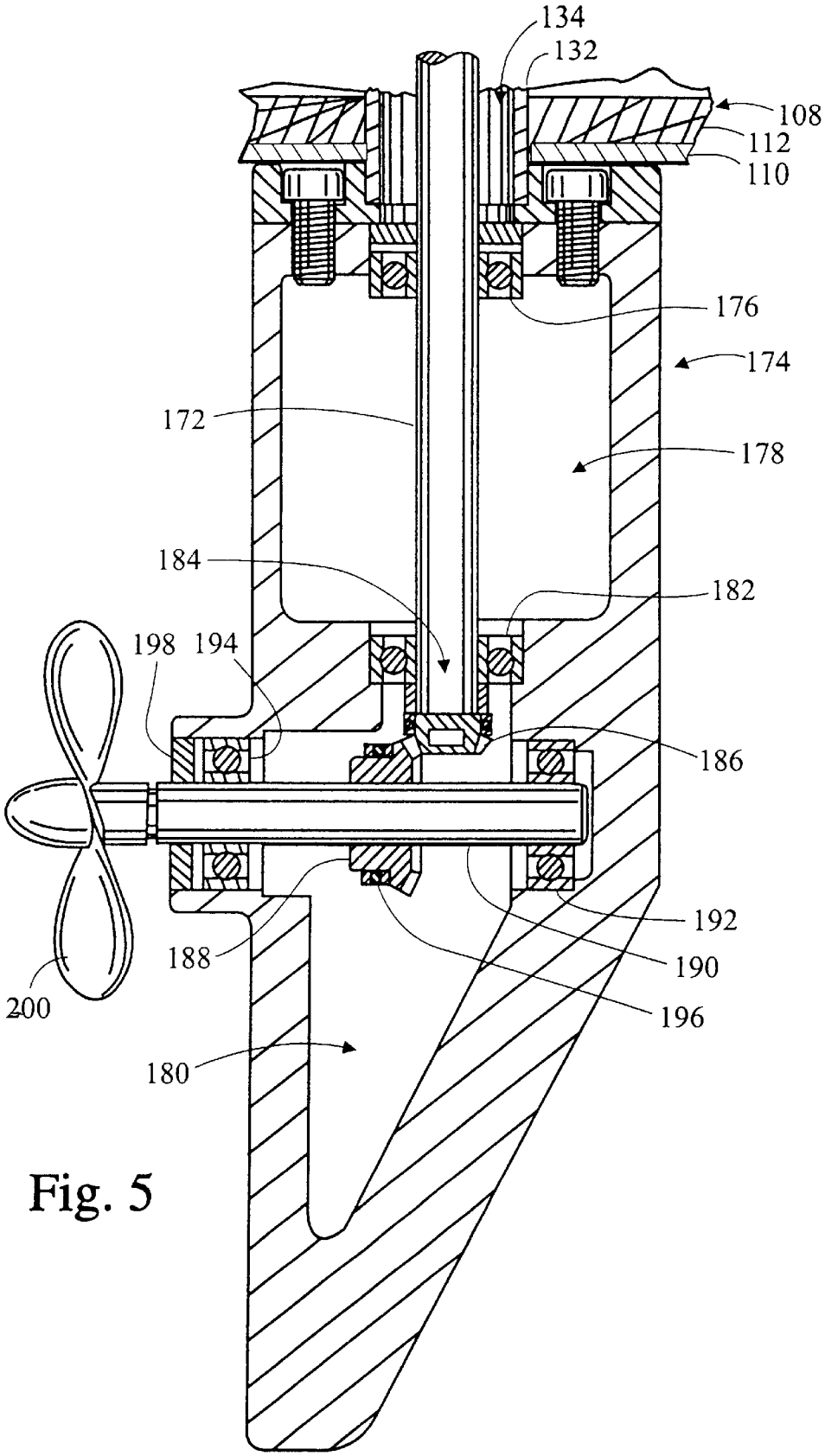
FIG. 5 is a cross-sectional view of the lower portion of the swivel drive assembly of the present invention.

Referring to FIGS. 5 and 6, the turning post 132 is fixedly attached to a shroud 174 that is disposed in the water outside the hull 108 of the boat 102. The turning post 132 is attached to the shroud 174 in a manner that provides a water tight seal. In this respect, water cannot enter the interior 134 of the turning post 132 through the attachment of the turning a post 132 with the shroud 174. The interior 134 will therefore remain dry, as well as the drive shaft 172.

The shroud 174 is fixedly attached to the turning post 132 such that as the turning post 132 is rotated, the shroud 174 will also rotate. Referring to FIG. 5, the shroud 174 is formed with an upper cavity 178 and a lower cavity 180. An annular upper drive shaft bearing 176 is disposed in the upper cavity to support the drive shaft 172 as it extends through the upper cavity 178. Disposed in the lower cavity 180 is a lower drive shaft bearing 182 which supports a lower end 184 of the drive shaft 172.

Fixedly attached on the lower end 184 of the drive shaft 172 is a drive shaft bevel gear 186. The drive shaft bevel gear 186 is in meshing engagement with a propeller shaft bevel gear 188. As seen in FIG. 5, the propeller shaft bevel gear 188 is fixedly attached to a propeller shaft 190. Accordingly ,the rotation of the drive shaft 172 will rotate the propeller shaft 190 via the drive shaft bevel gear 186 and the propeller shaft bevel gear 188. In the preferred embodiment of the present invention, the drive shaft bevel gear 186 and the propeller shaft bevel gear 188 are both complementary spiral cut bevel gears. By utilizing spiral cut bevel gears, whine and vibration from the gears 186, 188 are reduced and not transmitted into the boat 102.

The propeller shaft 190 is generally perpendicular to the drive shaft 172. The propeller shaft 190 is supported in the lower cavity 180 by a forward propeller shaft bearing 192 and an aft propeller shaft bearing 194. Additionally, the propeller shaft bevel gear 188 is supported by a propeller shaft bevel gear bearing 196. The propeller shaft 190 can therefore spin by the rotation of the drive shaft 172. In order to prevent water from entering the lower cavity 180 of the shroud 174, the propeller shaft 190 extends through a propeller shaft seal 198. The propeller shaft seal 198 circumferentially surrounds the propeller shaft 190 to provide a water-tight seal, but still allow the rotation of the propeller shaft 190. Attached to the end of the propeller shaft 190 extending from the propeller shaft seal 198 is a propeller 200.

The shroud 174 is typically fabricated from fiberglass and shaped similar to the rudder 30 used in the prior art propulsion system 12. By rotating the shroud 174, it is therefore possible to steer the boat 102 from the water flowing there over. Additionally, when the propeller 200 is spinning, and the shroud 174 is rotated, then the propeller 200 will pointed in a direction that will turn the boat 102. In this respect, by pointing the propeller 200 (as it is rotating) with the shroud 174, it is easier to turn the boat 102 at slow speed. This allows for easy docking and maneuvering of the boat 102.

In order to steer the boat 102, the operator turns the steering wheel 104 in the desired direction which will correspondingly extend or retract the interior cable 130 of the steering cable 106. The extension or retraction of the interior cable 130 will correspondingly rotate the mounting plate 124 and turning post 132 attached thereto. As previously mentioned, the shroud 174 will rotate with the rotation of the turning post 132 because they are attached together. The rotation of the shroud 174 will therefore point the propeller 200 in the desired direction to steer the boat 102.

In addition to facilitating steerage of the boat 102, the swivel drive assembly 100 of the present invention additionally consumes less interior space of the boat 102 than the prior art system 12. As seen in FIG. 2, the swivel drive assembly 100 is mounted in the stern of the boat 102 which is typically used for storage. With the configuration of the present invention, the swivel drive assembly 100 consumes less interior space than the prior art propulsion system 12. Additionally, by vertically mounting the electric motor 118 directly above the shroud 174, the need for belt 22 and pulleys 20 and 24 is not needed thereby increasing the reliability and safety of the propulsion system for the electric boat 102.

Additional modifications and improvements of the present invention may also be apparent to those of ordinary skill in the art such as using two swivel drive assemblies 100 in a side-by-side configuration. Thus, the particular combination of parts described and illustrated herein is intended to represent only certain embodiments of the present invention, and is not intended to serve as limitations of alternative devices within the spirit and scope of the invention.

What is claimed is:

1. A swivel drive assembly for an electrically powered boat, the swivel drive assembly comprising:

a rudder-shaped shroud to direct water flow to steer the boat;

a propeller shaft extending through the shroud;

a propeller attached to the propeller shaft;

a straight tubular turning post attached to the shroud and rotatably mounted to the boat;

a drive shaft extending within the turning post and the shroud, the drive shaft being mechanically coupled to the propeller shaft; and an electric motor mechanically coupled to the drive shaft, the rotation of the electric motor being operable to spin the propeller;

wherein the rotation of the turning post is operative to point the propeller and the rudder shaped shroud in a desired direction in order to facilitate steering of the boat.

2. The swivel drive assembly of claim 1 further comprising a gear mechanism mechanically coupling the propeller shaft to the drive shaft.

3. The swivel drive assembly of claim 2 wherein the gear mechanism comprises a first bevel gear attached to the propeller shaft and a second bevel gear attached to the drive shaft and cooperatively engaged to the first bevel gear.

4. The swivel drive assembly of claim 3 wherein the first and second bevel gears are spiral cut bevel gears.

5. The swivel drive assembly of claim 1 further comprising a seal mounted to the boat, the seal having an interior bore sized slightly larger than the turning post such that the turning post is extensible through the seal, the centerline of the seal being in axial alignment with the centerline of the drive shaft.

6. The swivel drive assembly of claim 5 wherein the seal comprises a vibration dampening member configured to reduce vibrations between the swivel drive assembly and the boat.

7. The swivel drive assembly of claim 6 wherein the dampening member is formed from an elastomeric material.

8. A swivel drive assembly for an electrically powered boat, the swivel drive assembly comprising:

a shroud;

a propeller shaft extending through the shroud;

a propeller attached to the propeller shaft;

a tubular turning post attached to the shroud and rotatably mounted to the boat;

a drive shaft extending within the turning post and the shroud, the drive shaft being mechanically coupled to the propeller shaft;

an electric motor mechanically coupled to the drive shaft, the rotation of the electric motor being operable to spin the propeller; and a seal mounted to the boat, the seal having an interior bore sized slightly larger than the turning post such that the turning post is extensible through the seal, the seal further comprising;

a housing having a hollow interior;

a dampening member disposed within the hollow interior of the housing, the dampening member being formed with a cylindrical bore extending there through; and a cylindrical bushing disposed within the cylindrical bore of the dampening member, the bushing having a hollow interior sized slightly larger than the turning post such that the turning post is extensible therethrough;

wherein the rotation of the turning post is operative to point the propeller in a desired direction in order to facilitate steering of the boat.

9. The swivel drive assembly of claim 8 wherein the seal further comprises an oil seal disposed adjacent to the bushing and the turning post in order to prevent water from entering the boat.

10. The swivel drive assembly of claim 8 wherein the dampening member is formed from an elastomeric material.

11. The swivel drive assembly of claim 8 wherein the seal further comprises a bearing disposed adjacent to the bushing and the turning post in order to facilitate rotation of the turning post.

12. The swivel drive assembly of claim 1 further comprising a motor mount attached to the electric motor and the turning post wherein rotation of the motor mount rotates the turning post.

13. The swivel drive assembly of claim 1 wherein the electric motor further comprises an output shaft mechanically coupled to the drive shaft.

14. The swivel drive assembly of claim 13 further comprising a spline coupling mechanically coupling the output shaft to the drive shaft.

15. A swivel drive assembly for a boat, the swivel drive assembly comprising:

a housing having a hollow interior;

a dampening member having an interior surface, the dampening member disposed within the hollow interior of the housing, the dampening member being formed with a cylindrical bore extending therethrough, the dampening member having at least one notch defining an upper, lower, and interior circumferential surface, the at least one notch being on the interior surface of the dampening member, the upper and lower surface providing vibration dampening in a direction perpendicular to the upper and lower surface, the interior circumferential surface providing vibration dampening in a direction perpendicular to the interior circumferential surface; and a cylindrical bushing disposed within the cylindrical bore of the dampening member, the bushing having a hollow interior sized slightly larger than a turning post such that the turning post is extensible therethrough, the cylindrical bushing having notches that engage the at least one notch of the dampening member.

* * * * *